US005984650A

United States Patent [19]

Okubo et al.

[11] Patent Number: 5,984,650

[45] Date of Patent: Nov. 16, 1999

[54] PRESSURE FUEL PUMP DEVICE

[75] Inventors: Yoshio Okubo; Toshiaki Hori, both of Kanagawa, Japan

[73] Assignee: Unisia Jecs Corporation, Atsugi, Japan

[21] Appl. No.: 09/102,931

[22] Filed: Jun. 24, 1998

[30] Foreign Application Priority Data

Jun. 24, 1997 [JP] Japan ..... 9-166455
May 22, 1998 [JP] Japan ..... 10-140320

[51] Int. Cl.[6] ..... F04B 19/00; F01B 31/10

[52] U.S. Cl. ..... 417/470; 92/153

[58] Field of Search ..... 417/470; 184/6.7, 184/6.12; 92/153

[56] References Cited

U.S. PATENT DOCUMENTS 2,166,857 7/1939 Bugatti ..... 92/153
3,186,349 6/1965 Compton et al. ..... 417/470
5,775,203 7/1998 Osborn et al. ..... 92/128

FOREIGN PATENT DOCUMENTS 4-117185 10/1992 Japan .

*Primary Examiner*—William Doerrler
*Attorney, Agent, or Firm*—Foley & Lardner

[57] ABSTRACT

A pressure fuel pump device for use with an internal combustion engine comprises a pump body which has therein first and second chambers which are aligned and merged A cylinder member is installed in the pump body. A plunger is reciprocatively movably disposed in the cylinder member to define in the cylinder member a pump chamber which is connected to both a fuel supply pump and fuel injectors through respective fuel passages. The plunger has one end exposed to the first chamber. A drive shaft is adapted to be rotated about its axis by an external power means. A rotation cam is provided on the drive shaft to rotate therewith. The end of the plunger is arranged to be pushed by the rotation cam upon rotation of the rotation cam. A bearing is disposed in the second chamber to rotatably support the drive shaft relative to the pump body. An oil intake passage is provided for feeding the first and second chambers with a lubricating oil, and an oil discharge passage is provided for discharging the lubricating oil from the first and second chambers.

18 Claims, 7 Drawing Sheets

PRESSURE FUEL PUMP DEVICE

BACKGROUND OF THE INVENTION

1. Field of the Invention

The present invention relates in general to fuel pumps and more particularly to pressure fuel pumps suitable to a fuel injection system of an automotive internal combustion engine. More specifically, the present invention is concerned with pressure fuel pump devices of a type which comprises a pump body having a cam chamber, a cylinder installed in the pump body, a plunger reciprocatively movably disposed in the cylinder to define in the cylinder a pump chamber, a drive shaft projected into the cam chamber, a rotation cam installed in the cam chamber and tightly disposed on the projected portion of the drive shaft to push up the plunger under rotatlon thereof, and a lubricating oil supply system for feeding the cam chamber with a lubricating oil.

2. Description of the Prior Art

For feeding a pressurized fuel to fuel injectors of a fuel injection system of an automotive internal combustion engine, there have been developed pressure fuel pump devices of a type in which a pump proper is arranged above an intake/exhaust valve driving cam shaft of the engine and a plunger of the pump proper is reciprocatively driven by a rotation cam disposed on the cam shaft. In the pressure fuel pump devices of this type, it is inevitably necessary to provide a cylinder head cover with an opening for installing therein the pump proper. This arrangement however tends to induce not only a complicated and bulky construction of the engine but also a limited layout of parts of the engine.

To eliminate these drawbacks, there has been proposed a type in which a drive shaft having the rotation cam mounted thereon is installed in a pump body for reclprocatlvely driving the plunger. In this type, it is necessary to drivingly connect the intake/exhaust valve driving cam shaft to the drive shaft. One of the pressure fuel pump devices of this type is disclosed by Japanese Utility Model First Provisional Publication 4-117185. In the pressure fuel pump device of this publication, there are defined in the pump body cam and bearing chambers at a portion isolated from a pump chamber of the pump proper and the two chambers are filled with a lubricating oil to lubricate various parts and portions installed therein.

However, even the pressure fuel pump device of the publication fails to satisfy users for such a reason that the lubricating ability of the oil may deteriorate in a relatively short time. In fact, the pressure fuel pump device of the publication is so constructed as to shut the lubricating oil in the two chambers, which has a high possibility of hastening deterioration of the lubricating oil.

SUMMARY OF THE INVENTION

It is therefore an object of the present invention to provide a pressure fuel pump device which is free of the above-mentioned drawbacks.

According to the present invention, there is provided a pressure fuel pump device that features that the cam chamber and bearing chamber are continuously fed with a lubricating oil under operation of the pump device.

According to a first aspect of the present invention, there is provided a pressure fuel pump device which comprises a pump body having therein first and second chambers which are aligned and merged; a cylinder member installed in the pump body; a plunger reciprocatively movably disposed in the cylinder member to define in the cylinder member a pump chamber which is adapted to be connected to fuel supply means, the plunger having one end exposed to the first chamber; a drive shaft adapted to be rotated about its axis by an external power means; a rotation cam provided on the drive shaft to rotate therewith, the end of the plunger being arranged to be pushed by the rotation cam upon rotation of the rotation cam; a bearing disposed in the second chamber to rotatably support the drive shaft relative to the pump body; an oil intake passage having one open end exposed to the first chamber to feed the first and second chambers with a lubricating oil; and an oil discharge passage having one open end exposed to the first chamber to discharge the lubricating oil from the first and second chambers.

According to a second aspect of the present invention, there is provided a pressure fuel pump device for use with an internal combustion engine. The device comprises a pump body having therein first and second chambers which are aligned and merged; a cylinder member installed in the pump body; a is plunger reciprocatively movably disposed in the cylinder to define in the cylinder member a pump chamber which is adapted to be connected to fuel supply means, the plunger having one end exposed to the first chamber; a drive shaft coaxially connected to an intake/exhaust valve driving cam shaft of the engine to rotate therewith, the drive shaft having a leading portion projected into the first and second chamber; a rotation cam located in the first chamber and tightly disposed on the leading portion of the drive shaft to rotate therewith, the end of the plunger being arranged to be pushed by the rotation cam upon rotation of the rotation cam; a bearing disposed in the second chamber to rotatably support the leading portion of the drive shaft relative to the pump body; and oil intake and discharge passages defined in the pump body, each passage having one end exposed to the first chamber, wherein the oil intake passage is connected to an oil gallery of the engine to which a lubricating oil is led from an oil pump, so that under operation of the engine, the oil is fed to the first and second chambers through the oil intake passage and the oil in tile chambers is returned back to the oil pump through the oil discharge passage.

According to a third aspect of the present invention, there is provided a pressure fuel pump device for use with an internal combustion engine. The device comprises a pump body having therein first, second and third chambers which are aligned and merged, the first chamber being arranged between the second and third chambers; a cylinder member installed in the pump body; a plunger reciprocatively movably disposed in the cylinder to define in the cylinder member a pump chamber which is adapted to be connected to fuel supply means, the plunger having one end exposed to the first chamber; a leading portion of an intake/exhaust valve driving cam shaft of the engine, the leading portion being projected into the first, second and third chambers; a rotation cam located in the first chamnber and integral with the leading portion of the cam shaft to rotate therewith, the end of the plunger being arranged to be pushed by the rotation cam upon rotation, of the rotation cam; bearings respectively disposed in the second and third chambers to rotatably support the leading portion of the cam shaft relative to the pump body; an oil intake passage defined in the leading portion of the cam shaft, the oil intake passage having oil outlet ports in the rotation cam at leading parts of tops of lobes of the rotation cam with respect to the direction which the rotation cam rotates; and an oil discharge passage defined in the pump body, the oil discharge passage having an oil inlet opening exposed to the first chamber, wherein the oil intake passage is connected to an oil gallery of the engine to which a lubricating oil is led from an oil pump, so that under operation of the engine, the oil is fed to the first, second and third chambers through the oil intake passage and the oil in the chambers is returned back to the oil pump through the oil discharge passage.

BRIEF DESCRIPTION OF THE DRAWINGS

Other objects and advantages of the present invention will become apparent from the following when taken in conjunction with the accompanying drawings, in which.

DETAILED DESCRIPTION OF THE EMBODIMENTS

For ease of understanding the following description will be made with an aid of directional words, such as, upper, upward, lower, downward, left, right, . . . and the like. However, these words are to be understood with respect to only FIG. 1 and FIG. 6 in which first and second embodiments of the invention are respectively illustrated. That is, such directional words are used only for ease of understanding the positional relationship of the parts employed in the invention.

Figure 1:
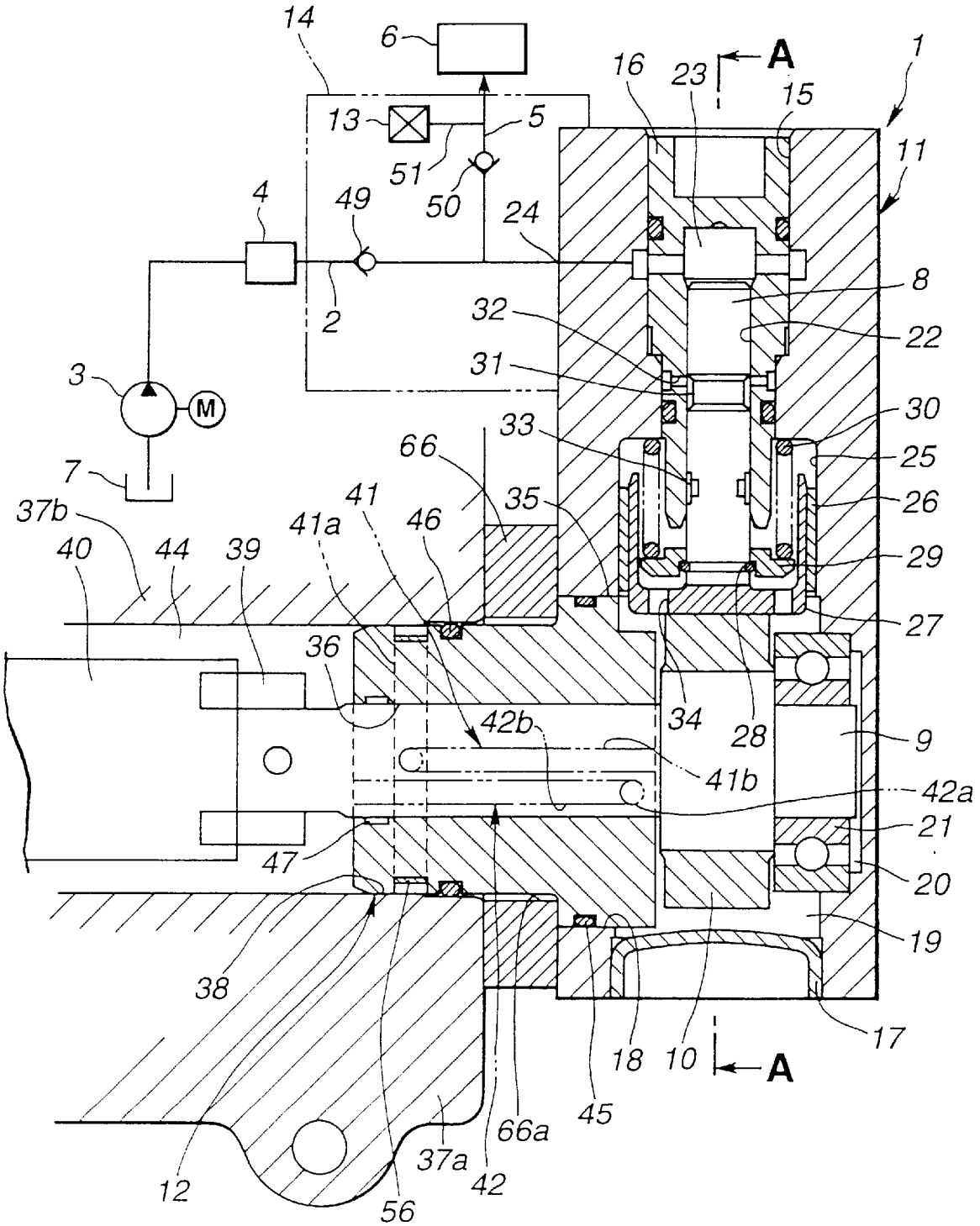
FIG. 1 is a sectional view of a pressure fuel pump device which is a first embodiment of the present invention.

Referring to FIGS. 1 to 5, particularly FIG. 1, there is shown a pressure fuel pump device 1 which is a first embodiment of the present invention. In this embodiment, the pressure fuel pump device 1 is arranged for feeding a pressurized fuel to fuel injectors of a fuel injection system of an automotive internal combustion engine. That is, as is seen from FIG. 1, a fuel induction passage 2 extends from a fuel tank 7 to an inlet/outlet port 24 of the pressure fuel pump device 1. An electric fuel pump 3 and a low pressure regulator 4 are connected to the fuel induction passage 2. A fuel discharge passage 5 extends from the inlet/outlet port 24 to fuel injectors 6 of the fuel injection system. A pressure regulator 13 is connected to the fuel discharge passage 5. That is, as will be described in detail hereinafter, due to work of the electric fuel pump 3, the fuel in the fuel tank 7 is led to the pressure fuel pump device 1 to be pressurized, and then the pressurized fuel is led to the fuel injectors 6.

As is seen from FIG. 1, the pressure fuel pump device 1 comprises generally a plunger 8 which is reciprocatively moved for achieving a pumping action, a drive shaft 9 which extends perpendicular to an axis of the plunger 8 and is driven by the engine and a rotation cam 10 which is tightly disposed on the is drive shaft 9 to rotate therewith. The rotation cam 10 puts thereon the plunaer 8 through an after-mentioned lifter 27, so that when the rotation cam 10 is rotated, the plunger 8 is axially moved in a reciprocating manner. For the reciprocation, a biasing coil spring 30 is associated with the plunger 8 for biasing the same toward the rotation cam 10. As will become apparent as the description proceeds, due to the reciprocating movement of the plunger 8, the fuel led into a pump chamber 23 is pressurized and discharged to the fuel injectors 6. It is to be noted that the number of lobes of the rotation cam 10 is the same as that of the fuel injectors 6, that is, the number of cylinders of the engine. In the illustrated embodiment, the number of the lobes of the cam 10 is four.

As is seen from FIG. 1, the pump body of the pressure fuel pump device 1 comprises a pump block 11 which receives therein the piunger 8, a shaft receiving block 12 which rotatably receives therein part of the drive shaft 9 and an outlet block 14 which has therein the fuel induction and discharge passages 2 and 5 and the pressure regulator 13.

The pump block 11 has a generally cylindrical structure with a cylindrical center bore 15. A cylindrical hollow member 16 is tightly received in an upper portion of the center bore 15, and a blind cap 17 is fitted in a lower end of the center bore 15. As shown, an upper portion of the cylindrical hollow member 16 is closed so that a cylindrical hollow 22 of the same constitutes a blind bore, and a lower open end of the member 16 is located at a generally middle portion of the center bore 15. In a lower part of the pump block 11, there is defined a lateral bore 18 whose axis is perpendicular to the axis of the cylindrical center bore 15. Due to provision of this lateral bore 18, there are defined in the lower portion of the pump block 11 both a cam chamber 19 for receiving the rotation cam 10 and a bearing chamber 20 for receiving a radial bearing 21. The hollow 22 of the cylindrical hollow member 16 is open to the cam chamber 19 and has a base portion of the plunger 8 axially slidably received therein Thus, the upper portion of the hollow 22, into which the base portion of the plunger 8 is exposed, constitutes the pump chamber 23. That is, due to the reciprocating movement of the plunger 8, the volume of the pump chamber 23 is forced to change, that is, to increase and reduce repeatedly. The pump chamber 23 is merged with the inlet/outjet port 24 through which intake and discharge of the fuel into and from the pump chamber 23 are carried out.

As shown, the generally middle portion of the center bore 15 of the pump block 11 is radially enlarged to constitute a lifter chamber 25. A metal bush 26 is tightly received in the lifter chamber 25 having its outer surface pressed against a peripheral wall of the lifter chamber 25. A bottomed cylindrical lifter 27 is axially sildably put in the metal bush 26. As shown, a lower end of the plunger 8 contacts a center part of the bottom of the lifter 27 and the rotation cam 10 puts thereon the bottom of the lifter 27. A suitable surface treatment is applied to a lower surface of the bottom of the lifter 27 for eliminating or at least minimizing abrasion of the bottom which would occur when the rotation cam 10 slides on the bottom An annular spring seat 29 is fixed to the lower end of the plunger 8 through a snap ring 28, and the coil spring 30 is compressed between the spring seat 29 and an upper wall of the lifter chamber 25. Thus, the plunger 8 is biased toward the rotation cam 10 pressing the lifter 27 against the rotation cam 10.

The plunger 8 is formed at a generally middle portion thereof with an annular groove 31, and the cylindrical hollow member 16 is formed at a portion near the annular groove 31 with a fuel returning passage 32 which leads to the fuel injection passage 2. That is, under operation, the annular groove 31 collects the fuel which would leak from the plump chamber 23 through a space defined between the hollow 22 and the plunger 8 and the collected fuel in the annular groove 31 is led back to the fuel induction passage 2 through the fuel returning passage 32, The plunger 8 is provided, at a portion between the annular groove 31 and the lower end thereof, with a seal ring 33 by which undesired fuel leakage from the annular groove 31 toward the lifter chamber 25 is assuredly avoided. The bottom of the cylindrical lifter 27 is formed with a plurality of openings 34 through which an interior of the cylindrical lifter 27 and the lifter chamber 25 are communicated.

As is seen form FIG. 1, the shaft receiving block 12 has a generally cylindrical structure with a cylindrical center bore 36. As shown, an enlarged right end 35 of the shaft receiving block 12 is fitted in the above-mentioned lateral bore 18 of the pump block 11. The drive shaft 9 is rotatably received in the cylindrical center bore 36 with its right end portion projected into the cam chamber 19 and its left end portion projected into an after-mentioned mounting bore 38. The projected right end portion of the drive shaft 9 has the rotation cam 10 tightly mounted thereon, and the projected right end of the drive shaft 9 is rotatably held by the pump block 11 through the radial bearing 21.

A left half of the shaft receiving block 12 is tightly received in the mounting bore 38 which is defined between a cylinder head 37*a* of the engine and a head cover 37*b*. The mounting bore 38 is a part of a cam shaft receiving bore 44. The projected left end of the drive shaft 9 is coaxialty connected through a coupler 39 to an intake/exhaust valve driving cam shaft 40 (viz., a cam shaft for driving cams for intake and exhaust valves) which is installed in the cam shaft receiving bore 44.

Figure 4:
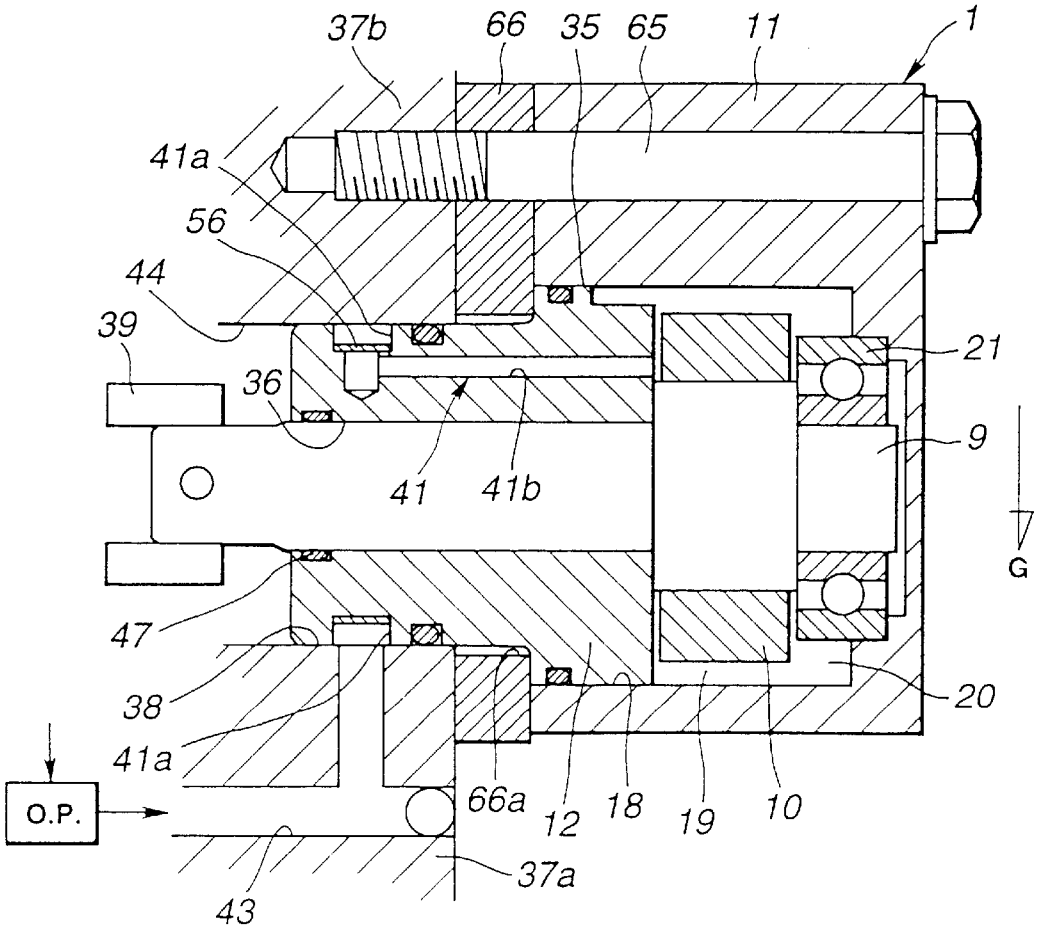
FIG. 4 is a sectional view taken along the line C—C of FIG. 2.

As is seen from FIGS. 4 and 1, the pump block 11 is secured to a side portion of the cylinder head 37*a* and that of the head cover 37*b* by means of a connecting bolt 65 which extends in parallel with the drive shaft 9, A heat insulating member 66 is interposed between the pump block 11 and each of the cylinder head 37*a* and the heat cover 37*b*. The heat insulating member 66 is formed with an opening 66*a* for receiving therein the shaft receiving block 12. As is seen the drawings, the diameter of the opening 66*a* is smaller than an outer diameter of the enlarged right end 35 of the shaft receiving block 12. Thus, due to provision of the heat insulating member 66, a leftward displacement of the block 12 is suppressed.

Figure 2:
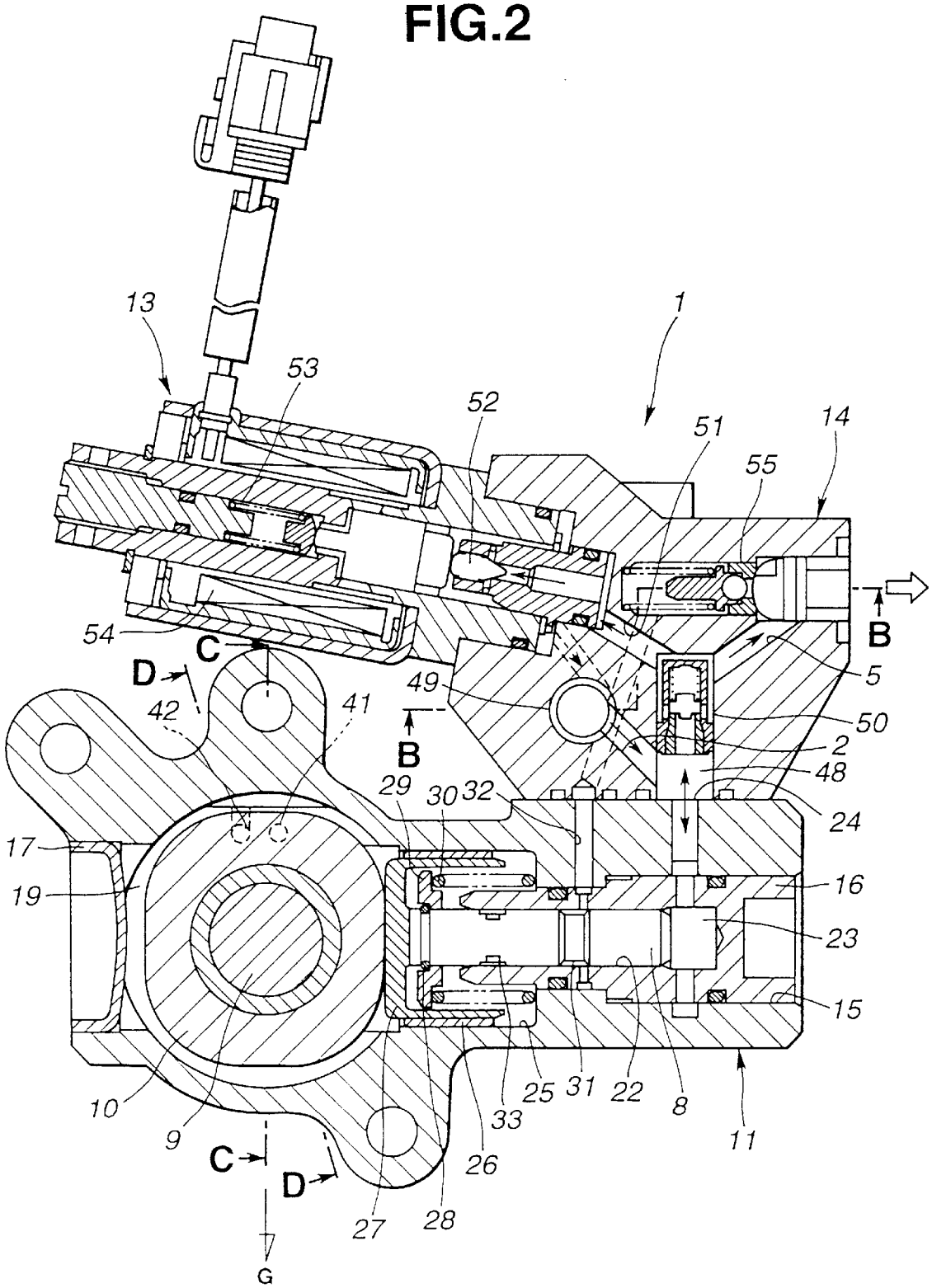
FIG. 2 is a sectional view taken along the line A—A of FIG. 1.
Figure 3:
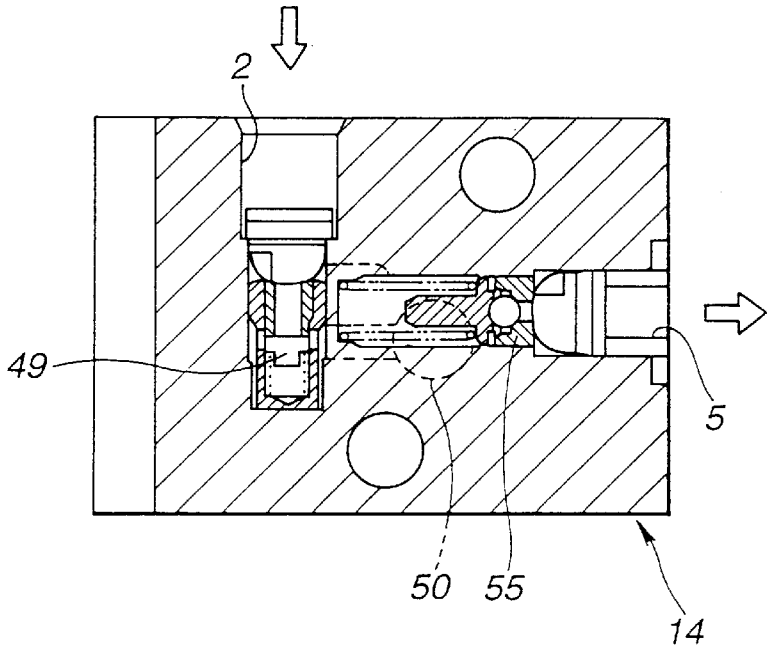
FIG. 3 is a sectional view taken along the line B—B of FIG. 2.

As is understood from FIGS. 1, 2 and 4, the shaft receiving block 12 is formed with oil intake and discharge passages 41 and 42 which are used for feeding the cam chamber 19, the bearing chamber 20 and the lifter chamber 25 with a lubricating oil.

As is seen from FIG. 4, the oil intake passage 41 comprises an annular groove 41*a* formed in a cylindrical outer wall of the block 12 and an axially extending bore 41*b* formed in the block 12. The annular groove 41*a* is connected to an upstream part of an oil gallery 43 of the cylinder head 37*a*. The axially extending bore 41*b* connects the annular groove 41*a* with the cam chamber 19.

Figure 5:
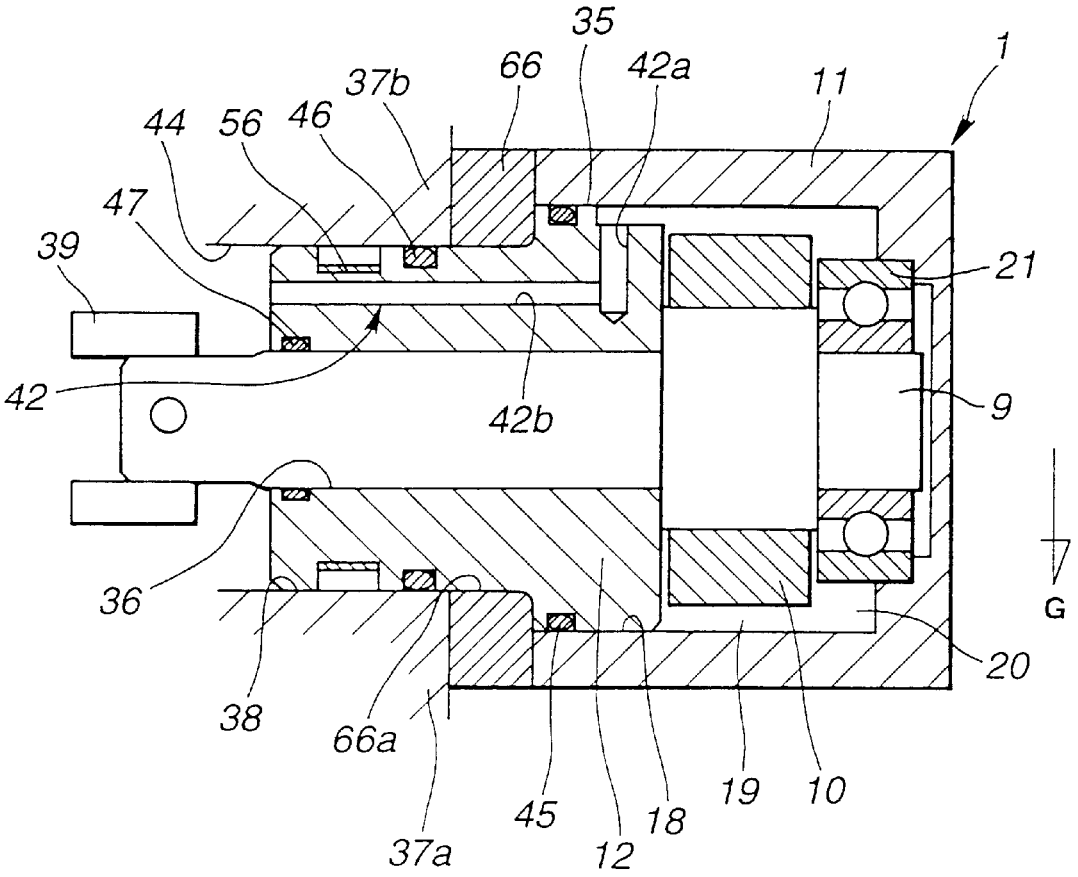
FIG. 5 is a sectional view taken along the line D—D of FIG. 2.

As is seen from FIG. 5, the oil discharge passage 42 comprises a radially extending bore 42*a* formed in the enlarged right end 35 of the block 12 and an axially extending bore 42*b* formed in the block 12. The radially extending bore 42*a* is exposed to the cam chamber 19. The axially extending bore 42*b* connects the radially extending bore 42*a* with the cam shaft receiving bore 44. It is to be noted that the cam shaft receiving bore 44 constitutes a downstream part of the oil gallery 43. It is further to be noted that the axially extending bore 41*b* of the oil intake passage 41 and the radially extending bore 42*a* of the oil discharge passage 42 are exposed to an upper portion of the cam chamber 19.

As is seen from FIG. 4, within the annusar groove 41*a* of the block 12, there is disposed a filter member 56 which covers at least a part through which the axially extending bore 41*b* is connected to the annular groove 41*a*. The oil gallery 43 is connected to an oil pump (not shown) driven by the engine, so that under operation of the engine, a pressurized lubricating oil is continuously led to the oil intake passage 41 from the oil pump.

Referring back to FIG. 1, an oil seal 45 is interposed between the enlarged right end 35 of the shaft receiving block 12 and a wall of the lateral bore 18 of the pump block 11. An oil seal 46 is interposed between the shaft receiving block 12 and a well of the mounting bore 38, and an oil seat 47 is interposed between the drive shaft 9 and a wall of the center bore 36 of the block 12.

As is clearly seen from FIG. 2, the outlet block 14 is formed with arr inlet/outlet chamber 48 which is connected to the inlet/outlet port 24 of the pump block 11. The fuel induction passage 2 and the fuel discharge passage 5 are defined in the outlet block 14, which are connected to the inlet/outlet chamber 48. The fuel induction and discharge passages 2 and 5 are provided, near the inlet/outlet chamber 48, with respective check valves 49 and 50. As is seen from FIG. 1, the check valve 49 is arranged to permit only a flow of the fuel in a direction toward the inlet/outlet port 24 (viz., inlet/outlet chamber 48), while, the other check valve 50 is arranged to permit only a flow of the fuel in a direction away from the port 2. That is, under operation of the fuel pump device, the two check valves 49 and 50 are opened or closed alternately.

Referring back to FIG. 2, the outlet block 14 is further formed with a return passage 51 through which the discharge passage 5 is connected to the induction passage 2. The pressure regulator 13 is disposed in the return passage 51 to regulate or adjust the fuel pressure in the fuel discharge passage 5 to a predetermined level.

As is seen from FIG. 2, the pressure regulator 13 generally comprises a poppet valve 52 arranged to open and close the return passage 51 and a biasing spring 53 arranged to bias the poppet valve 52 in a direction to close the return passage 51. That is, when the pressure in the fuel discharge passage 5 becomes greater than the biasing force of the spring 53, the poppet valve 52 opens the return passage 51. The pressure regulator 13 further comprises a solenoid device 54 by which the biasing force of the spring 53 is controlled in accordance with an operation load of the engine.

A relief valve 55 is installed in the fuel discharge passage 5, which is opened when the pressure in the discharge passage 5 becomes abnormally high. That is, upon opening of the relief valve 55, the highly pressurized fuel is led to the return passage 51.

In the following, operation of the above-mentioned pressure pump device 1 of the first embodiment will be described with reference to FIG. 1.

Under operation of the engine, the drive shaft 9 rotates together with the cam shaft 40. Thus, the rotation cam 10 on the drive shaft 9 pushes up the after 27 intermittently, and thus, the plunger 8 is reciprocatively moved in the fixed hollow member 16, with an aid of the coil spring 30.

That is, when the plunger 8 is moved down, the pump chamber 23 becomes negative in pressure and thus the fuel from the fuel pump 3 is led into the pump chamber 23 through fuel induction passage 2, the check valve 49 and the inlet/outlet port 24 (viz., inlet/outlet chamber 48, see FIG. 2). When thereafter the plunger 8 is moved up, the fuel in the pump chamber 23 and the inlet/outlet chamber 48 is pressurized and thus the other check valve 50 is opened. Upon opening of the check valve 50, the pressurized fuel in the pump chamber 23 and the inlet/outlet chamber 48 is led to the fuel injectors 6 through the inlet/outlet opening 24, the fuel discharge passage 5 and the opened check valve 50. With repetition of the axial movement of the plunger 8, the above-mentioned pumping action is continued. When the pressure in the fuel discharge passage 5 exceeds a certain level, the pressure regulator 13 instantly provides the above-mentioned bypass way to lower the pressure in the passage 5. That is, due to operation of the pressure regulator 13, the pressure of the fuel directed toward the fuel injectors 6 is regulated to a predetermined level. As is described hereinabove, the level is controlled in accordance with the operation load of the engine.

Under operation of the engine, a pressurized lubricating oil from the oil pump (not shown) is distributed to various portions of the engine. Part of the lubricating oil is led to the oil intake passage 41 (see FIG. 4) of the pressure fuel pump device 1 through the oil gallery 43. The lubricating oil from the oil intake passage 41 flows through the cam chamber 19, the bearing chamber 20 and the lifter chamber 25 to the oil discharge passage 42, and to the cam shaft receiving bore 44 located above the cylinder head 37. Thus, the radial bearing 21, the rotation cam 10, the lifter 27 and the plunger 8, etc., are suitably lubricated. That is, mutually contacting portions of these parts are sufficiently lubricated with the oil.

It is to be noted that in the above-mentioned first embodiment of the invention, the lubricating oil flows through the cam chamber 19, the bearing chamber 20 and the lifter chamber 25 and returns back to the oil pump, unlike in case of the above-mentioned pressure fuel pump device of Japanese Utility Model First Provisional Publication 4-117185. That is, in the first embodiment, the lubricating oil is not shut in the chambers 19, 20 and 25, which prevents or at least minimizes deterioration of the oil.

When, upon stopping of the engine, the of pump is stopped, the of, supply toward the oil intake passage 41 stops. However, even in this case, since the axially extending bore 41*b* of the oil intake passage 41 and the radially extending bore 42*a* of the oil discharge passage 42 are exposed to the upper portion of the cam chamber 19, only small amount of the lubricating oil flows back to the outside of the pump device 1 from the chambers 19, 20 and 25 through the passages 41 and 42. That is, a larger amount of the oil is left in the chambers 19 and 20, which assures lubrication of the mutually contacting portions of the rotation cam 10 and the lifter 27 and those of the radial bearing 21 upon restarting of the engine.

In the first embodiment, for lubricating the parts in the chambers 19, 20 and 25 with a flowing lubricating oil, the already constructed oil distribution system of the engine is used. This can reduce the cost of the engine. Furthermore, usage of the filter member 56 (see FIG. 4) promotes prolongation of the lubricating oil.

If desired, the oil intake and discharge passages 41 and 42 (see FIG. 4) may be provided with respective check valves. The check valve for the intake passage 41 permits only a flow of the oil in a direction toward the cam chamber 19, and the check valve for the oil discharge passage 42 permits only a flow of the oil in a direction away from the cam chamber 19. When employing this measure, there is no need of employing the above-mentioned arrangement wherein the axially extending bore 41*b* of the oil intake passage 41 and the radially extending bore 42*a* of the oil discharge passage 42 are exposed to the upper portion of the cam chamber 19. If a spring of the check valve for the oil discharge passage 42 has a relatively large spring constant, the undesired oil escape from the chambers 19 and 20 is much assuredly suppressed.

Furthermore, if desired, one of the intake and discharge oil passages 41 and 42 may be exposed a lower portion of the cam chamber 19. In this case, the passage 41 or 42 which is exposed to the lower portion is provided with a check valve. When employing this measure, the flow of the lubricating oil through the cam chamber 19, the bearing chamber 20 and the lifter chamber 25 is much smoothly carried out.

In the following, a pressure fuel pump 101 of a second embodiment of the present invention will be described with reference to FIGS. 6 to 8. For ease of understanding, the description will be made with an aid of directional words, such as, upper, upward . . . , and the like. However, these words are to be understood with respects to only FIG. 6.

Figure 6:
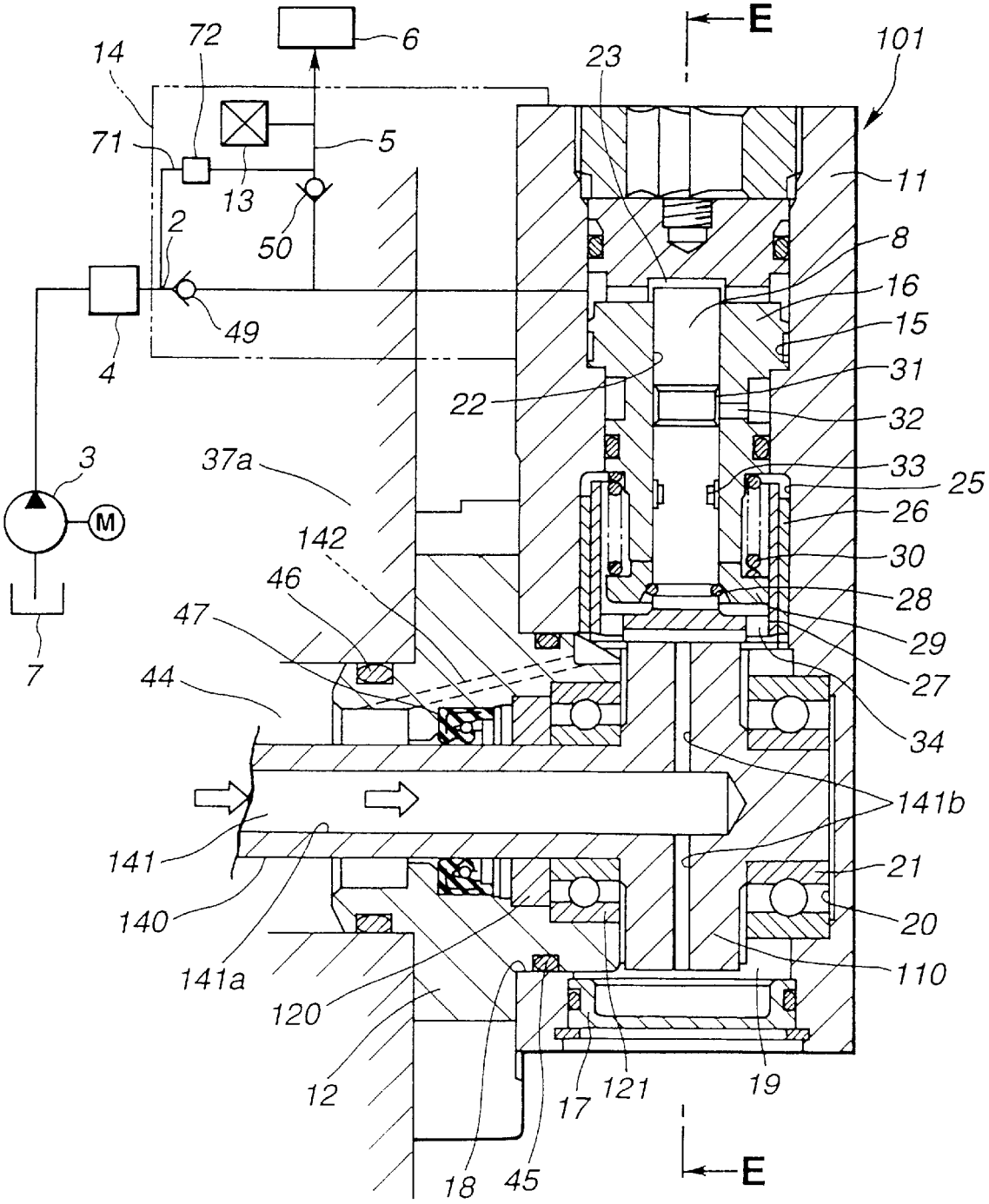
FIG. 6 is a section view of a pressure fuel pump device which is a second embodiment of the present invention.
Figure 7:
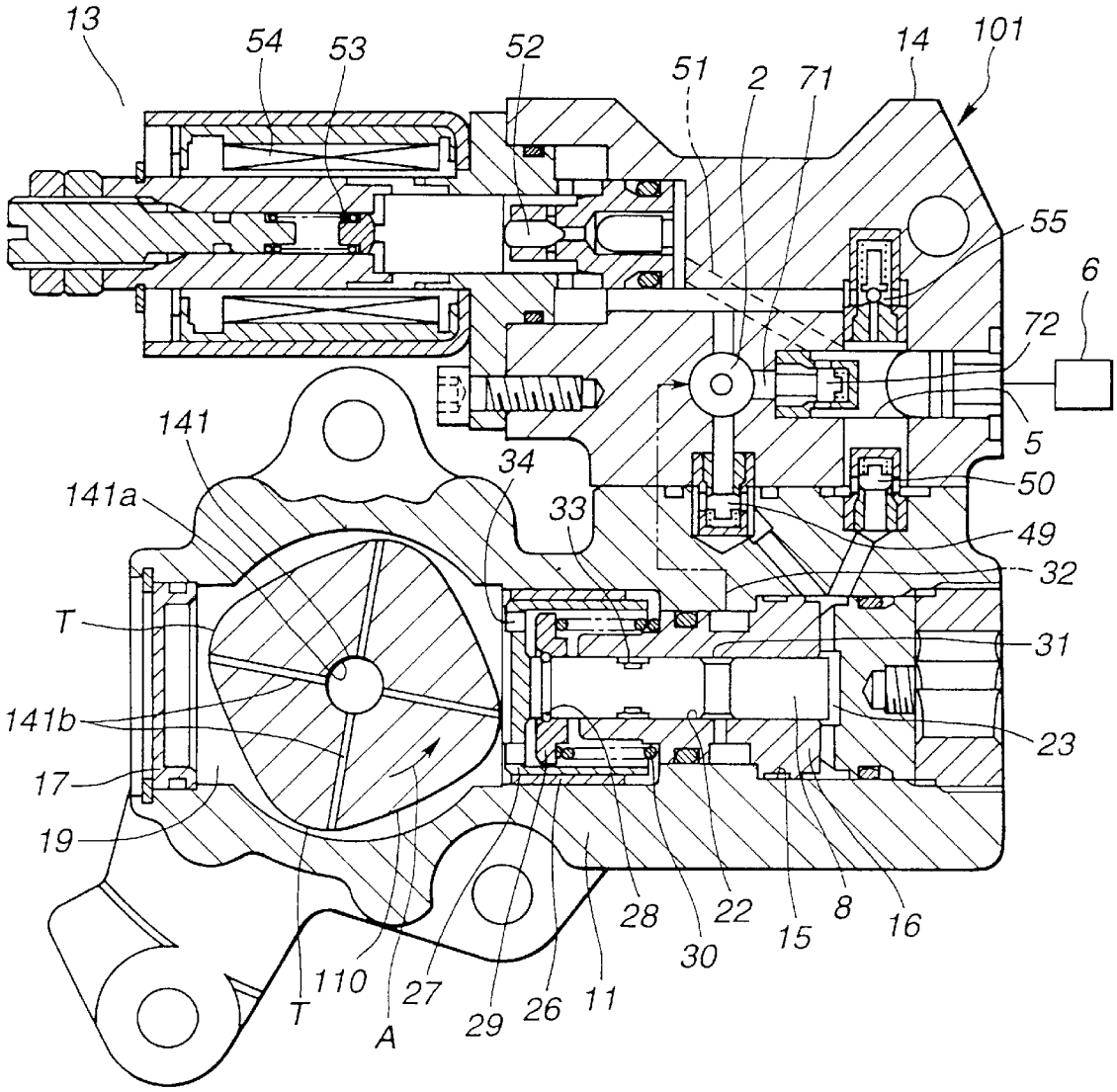
FIG. 7 is a sectional view taken along the line E—E of FIG. 6.
Figure 8:
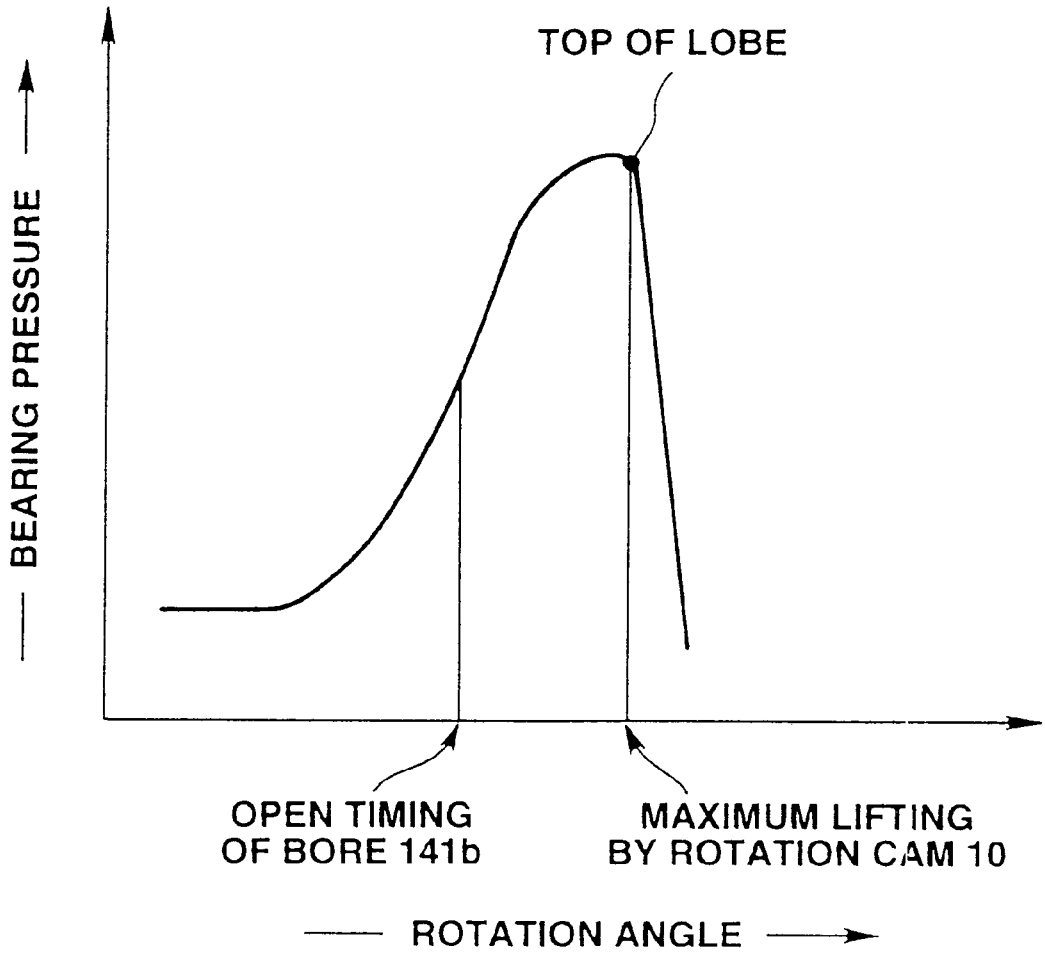
FIG. 8 is a graph showing the contacting manner between a is rotation cam and a lifter in terms of a relationship between a bearing pressure and a rotation angle of the rotation cam.

Referring to FIGS. 6 to 8, particularly FIG. 6, there is shown the pressure fuel pump device 101 of second embodiment of the present invention. Since the pump device 101 of the second embodiment is similar in construction to the above-mentioned first embodiment 1, only parts and construction which are different from those of the first embodiment will be described in detail in the following, and substantially same parts are denoted by the same numerals.

As is seen from FIG. 6, similar to the first embodiment, the pressure fuel pump device 101 of the second embodiment has a pump body which comprises a pump block 11, a shaft receiving block 12 and an outlet block 14. The pump block 11 has a cylindrical hollow member 16 tightly disposed therein and a plunger 8 axially movably disposed in the cylindrical hollow member 16. The outlet block 14 has fuel induction and discharge passages 2 and 5 and a pressure regulator 13 contained therein.

In the second embodiment 101, a drive shaft held by the shaft receiving block 12 for driving the plunger 8 is integral with an intake/exhaust valve driving cam shaft 140 of the engine. That is, a right end portion of the cam shaft 140 is projected from a cylinder head 37*a* and received in both the shaft receiving block 12 and the pump block 11. The projected right end portion of the cam shaft 140 is integrally formed with a rotation cam 110 on which the plunger 8 is put through a lifter 27. As shown, a pair of radial bearings 21 and 121 are installed in a cam chamber 19 for rotatably supporting the rotation cam 110 relative to the blocks 11 and 12. The bearing 21 is connected to the block 11, and the other bearing 121 is connected to the other block 12. Thus, in this second embodiment, two bearing chambers 20 and 120 are provided for the bearings 21 and 121.

For feeding the cam chamber 19 and the two bearing chambers 20 and 120 with a lubricating oil, an oil intake passage 141 is defined in the cam shaft 140. The oil intake passage 141 is connected to an oil pump (not shown) driven by the engine. For discharging the lubricating oil from the three chambers 19, 20 and 120, an oil discharge passage 142 is formed in the shaft receiving block 12.

The oil intake passage 141 comprises an axially extending bore 141*a* formed in the cam shaft 140 and four radially extending bores 141*b* (see FIG. 7) formed in the rotation cam 110, each bore 141*b* being connected to the bore 141*a*.

As is seen from FIG. 7, each radially extending bore 141*b* has an oil outlet opening at a leading part of the top of a corresponding lobe of the rotation cam 110 with respect to the rotation direction denoted by an arrow "A". Accordingly, under rotation of the rotation cam 110, the lubricating oil discharged from the discharge opening is smoothly led into mutually contacting surfaces of the rotation cam 110 and the lifter 27.

As is seen from FIG. 6, the oil discharge passage 142 extends obliquely near the radial bearing 121 and an oil seal 47 to connect the cam chamber 19 with a cam shaft receiving bore 44 which is positioned above a cylinder head 37*a*. Accordingly, the lubricating oil which has been led into the cam chamber 19 and the bearing chambers 20 and 120 from the oil intake passage 141 is discharged to the cam shaft receiving bore 44 through the oil discharge passage 142. Thereafter, the lubricating oil applies to various parts of the engine for lubricating the same.

If desired, in place of the oil discharge passage 142, a clearance suitably provided between the cam shaft 140 and the shaft receiving block 12 may be used as a passage for discharging the oil.

As is seen from FIG. 7, a pump chamber 23 defined by the plunger 8 is connected to both a fuel induction passage 2 and a fuel discharge passage 5 through respective check valves 49 and 50, like in the Base of the first embodiment. Between the fuel induction and discharge passages 2 and 5, there extends a bypass passage 71 in which a check valve 72 is installed. That is, when the engine is under cranking wherein sufficient pumping action is not achieved by the plunger 8, the fuel from the oil pump 3 (see FIG. 6) is directly led to the discharge passage 5 through the bypass passage 71.

Under operation of the engine, the rotation cam 10 pushes up the lifter 27 intermittently and thus the plunger 8 is reciprocatively moved with an aid of a spring 30. Thus, pumping action is carried out in substantially same manner as is described hereinabove in the section of the first embodiment.

Under operation of the engine, a pressurized lubricating oil is led to the oil intake passage 141 from the oil pump (not shown). The oil is then discharged to the cam chamber 19 through the four radially extending bores 141*b*. During this, the mutually contacting portions between the rotation cam 110 and the lifter 27 are suitably lubricated by the oil. The oil then flows through the bearing chambers 20 and 120 and flows into the cam shaft receiving bore 44 through the oil discharging passage 142.

As is described hereinabove, also in the second embodiment, the lubricating oil flows through the cam chamber 19, the bearing chambers 20 and 120 and the lifter chamber 25 and returns back to the oil pump, like in case of the first embodiment. Thus, the parts contained in the chambers 19, 20 and 120 are appropriately lubricated by the lubricating oil, unlike in case of the above-mentioned fuel pump device of Japanese Utility Model First Provisional Publication 4-117185.

FIG. 8 is a graph showing the contacting manner between the rotation cam 110 and the lifter 27 in terms of a relationship between a bearing pressure and a rotation angle of the rotation cam 110. As is understood from this graph and FIG. 7, when the top of each lobe of the rotation cam 110 is brought to contact with the lifter 27 against the maximum bearing pressure produced, the corresponding radially extending bore 141*b* has been already opened. This means that the lubricating oil is assuredly applied to the mutually contacting portions between the rotation cam 110 and the lifter 27 at the time when lubrication of them is most needed. Of course, this measure prevents or at least minimizes undesired abrasion of such contacting portions.

Although in the above-mentioned two embodiments 1 and 101 the lifter 27 is used for transmitting movement of the rotation cam 10 to the plunger 8, the lifter 27 may be removed. That is, in this case, the plunger 8 is directly put on the rotation cam 10.

What is claimed is:

1. A pressure fuel pump device comprising:

a pump body Leaving therein first and second chambers which are aligned and merged;

a cylinder member installed in said pump body;

a plunger reciprocatively movably disposed in said cylinder member to define in said cylinder member a pump chamber which is adapted to be connected to fuel supply means, said plunger having one end exposed to said first chamber;

a drive shaft adapted to be rotated about its axis by an external power means;

a rotation cam provided on said drive shaft to rotate therewith, said end of said plunger being arranged to be pushed by said rotation cam upon rotation of the rotation cam;

a bearing disposed in said second chamber to rotatably support the drive shaft relative to said pump body;

an oil intake passage having one open end exposed to said first chamber to feed said first and second chambers with a lubricating oil; and an oil discharge passage having one open end exposed to said first chamber to discharge the lubricating oil from said first and second chambers.

2. A pressure fuel pump device as claimed in claim 1, in which said drive shaft has a leading portion projected into said first chamber, said leading portion having said rotation cam provided thereon.

3. A pressure fuel pump device as claimed in claim 2, in which said rotation cam is integral with said leading portion.

4. A pressure fuel pump device as claimed in claim 2, in which the leading portion of said drive shaft is rotatably supported by said pump body through said bearing.

5. A pressure fuel pump device as claimed in claim 1, in which the open ends of said oil intake and discharge passages are located at an upper portion of said first chamber when said fuel pump device is properly arranged.

6. A pressure fuel pump device as claimed in claim 1, further comprising:

a first check valve installed in said oil intake passage to permit only a flow of the lubricating oil in a direction toward said first chamber; and a second check valve installed in said oil discharge passage to permit only a flow of the lubricating oil in a direction away from said first chamber.

7. A pressure fuel pump device as claimed in claim 1, in which one of the open ends of said oil intake and discharge passages is located at a lower portion of said first chamber when said fuel pump device is properly arranged, and in which the passage which has the selected open end has a check valve installed therein.

8. A pressure fuel pump device as claimed in claim 1, in which said oil intake passage is connected to an oil pump which is driven by an engine for feeding a lubricating oil to various portions and parts of the engine.

9. A pressure fuel pump device as claimed in claim 1, in which said oil intake passage has a filter installed therein.

10. A pressure fuel pump device as claimed in claim 8, in which said pump body is connected to said engine, and in which said oil intake and discharge passages are operatively connected to an oil gallery defined by said engine.

11. A pressure fuel pump device as claimed in claim 1, in which said oil intake passage has an oil outlet opening in said rotation cam at a portion which contacts the end of said plunger.

12. A pressure fuel pump device as claimed in claim 11, in which the oil outlet opening is positioned at a leading part of a top of a correcting lobe of the rotation cam with respect to a direction in which said rotation cam rotates.

13. A pressure fuel pump device as claimed in claim 1, further comprising a lifter which is interposed between the rotation cam and the end of said plunger.

14. A pressure fuel pump device as claimed in claim 13, further comprising biasing means which biases said plunger toward said rotation cam.

15. A pressure fuel pump device as claimed in claim 3, in which said drive shaft, leading portion and said rotation cam are integral with an intake/exhaust valve driving cam shaft of the engine.

16. A pressure fuel pump device as claimed in claim 15, in which said oil intake passage comprises:

an axially extending bore formed in said intake/exhaust valve driving cam shaft; and radially extending bores formed in said rotation cam and connected to said axially extending bore, each radially extending bore having an oil outlet opening at a leading part of the top of a corresponding lobe of the rotation cam with respect to the direction in which the rotation cam rotates.

17. A pressure fuel pump device for use with an internal combustion engine, comprising:

a pump body having therein first and second chambers which are aligned and merged;

a cylinder member installed in said pump body;

a plunger reciprocatively movably disposed in said cylinder to define in said cylinder member a pump chamber which is adapted to be connected to fuel supply means, said plunger having one end exposed to said first chamber;

a drive shaft coaxially connected to an intake/exhaust valve is driving cam shaft of said engine to rotate therewith, said drive shaft having a leading portion projected into said first and second chamber;

a rotation cam located in said first chamber and tightly disposed on said leading portion of the drive shaft to rotate therewith, said end of said plunger being arranged to be pushed by said rotation cam upon rotation of the rotation cam;

a bearing disposed in said second chamber to rotatably support said leading portion of the drive shaft relative to said pump body; and oil intake and discharge passages defined in said pump body, each passage having one end exposed to said first chamber, wherein said oil intake passage is connected to an oil gallery of the engine to which a lubricating oil is led from an oil pump of the engine, so that under operation of the engine, the oil is fed to the first and second chambers through said oil intake passage and the oil in the chambers is returned back to said oil pump through said oil discharge passage.

18. A pressure fuel pump device for use with an internal combustion engine, comprising:

a pump body having therein first, second and third chambers which are aligned and merged, said first chamber being arranged between said second and third chambers;

a cylinder member installed in said pump body;

a plunger reciprocatively movably disposed in said cylinder to define in said cylinder member a pump chamber which is adapted to be connected to fuel supply means, said plunger having one end exposed to said first chamber;

a leading portion of an intake/exhaust valve driving cam shaft of said engine, said leading portion being projected into said first, second and third chambers;

a rotation cam located in said first chamber and integral with said leading portion of the cam shaft to rotate therewith, said end of said plunger being arranged to be pushed by said rotation cam upon rotation of the rotation cam;

bearings respectively disposed in said second and third chambers to rotatably support said leading portion of the cam shaft relative to said pump body;

an oil intake passage defined in the leading portion of said cam shaft, said oil intake passage having oil outlet ports in said rotation cam at leading parts of tops of lobes of the rotation cam with respect to the direction which the rotation cam rotates; and an oil discharge passage defined in said pump body, said oil discharge passage having an oil inlet opening exposed to said first chamber, wherein said oil intake passage is connected to an oil gallery of the engine to which a lubricating oil is led from an oil pump of the engine, so that under operation of the engine, the oil is fed to the first, second and third chambers through said oil intake passage and the oil in the chambers is returned back to said oil pump through said oil discharge passage.

* * * * *